US005458924A

United States Patent [19]

Kashiwai et al.

[11] Patent Number: 5,458,924

[45] Date of Patent: Oct. 17, 1995

[54] METHOD OF IMPARTING LIGHT RESISTANCE AND ULTRAVIOLET-SCREENING ACTION TO FIBROUS ARTICLE

[75] Inventors: Kazuto Kashiwai, Akashi; Takaichi Yamamoto, Miki; Shinichi Kumagae, Kobe, all of Japan

[73] Assignee: Ipposha Oil Industries Co., Ltd., Hyogo, Japan

[21] Appl. No.: 149,710

[22] Filed: Nov. 9, 1993

Related U.S. Application Data

[63] Continuation of Ser. No. 864,618, Apr. 7, 1992, abandoned.

[30] Foreign Application Priority Data

Apr. 8, 1991 [JP] Japan ..... 3-103894

[51] Int. Cl.[6] ..... B05D 3/02; B05D 1/02; B05D 1/28

[52] U.S. Cl. ..... 427/389.9; 427/389; 427/421; 427/428; 427/430.1; 427/439; 428/264; 428/265; 428/270; 526/313; 526/316

[58] Field of Search ..... 427/389, 389.9, 427/421, 428, 430.1, 439; 428/264, 265, 270; 526/313, 316

[56] References Cited

U.S. PATENT DOCUMENTS

| | | | |
|---|---|---|---|
| 3,301,700 | 1/1967 | Maloney | 117/118 |
| 3,313,866 | 4/1967 | Horton et al. | 524/291 |
| 3,340,231 | 9/1967 | Fertig et al. | 260/47 |
| 3,365,421 | 1/1968 | Horton et al. | 526/313 |
| 3,629,197 | 12/1971 | Stiehl et al. | 260/474 |
| 4,728,540 | 3/1988 | Gasman | 427/389.9 |
| 4,861,651 | 8/1989 | Goldenhersh | 428/255 |

FOREIGN PATENT DOCUMENTS 1902459 8/1970 Germany .

1094365 5/1967 Switzerland .

OTHER PUBLICATIONS

Chemical Abstracts, vol. 110, No. 8, 17 Apr. 1989, p. 80, Abstract No. 136864G.

*Primary Examiner*—Anthony McFarlane
*Assistant Examiner*—Nhat D. Phan
*Attorney, Agent, or Firm*—Burgess, Ryan & Wayne

[57] ABSTRACT

A durable light resistance and UV-screening action is imparted to a fibrous article by coating the fibrous article with a polymer comprising units derived from at least one monomer selected from those which are represented by the formulae (1) and (2):

(1)

wherein R is H or $CH_3$ and X is —O—, —$OCH_2CH_2O$— or —$OCH_2CH(CH_3)O$—, (2)

wherein Y is halogen or $CH_3$, n is 1 or 2, $R_1$ is C1–6 hydrocarbyl, m is 1 or 2, $R_2$ is C1–6 alkylene and $R_3$ is H or $CH_3$.

8 Claims, 1 Drawing Sheet

METHOD OF IMPARTING LIGHT RESISTANCE AND ULTRAVIOLET-SCREENING ACTION TO FIBROUS ARTICLE

This application is a continuation of application Ser. No. 864,618, filed Apr. 7, 1992, now abandoned.

BACKGROUND OF THE INVENTION

1. Field of the Invention

This invention relates to a method of imparting a light resistance and an ultraviolet-screening action to a fibrous article.

2. Description of the Related Art

Most fibrous articles such as clothes including sports wears, beach umbrellas and curtains are exposed to sunlight in the outdoors. Therefore, the fibers of these articles deteriorate and the dyed fibrous articles discolor due to ultraviolet light. Furthermore, the skin gets sunburnt and furnishings are discolored by ultraviolet light transmitted through the fibrous articles.

To protect fibrous articles from photo-degradation and dyed fibrous articles from color fading, an ultraviolet absorber is adsorbed in the fibers. As the ultraviolet absorbers used, there can be mentioned 2-hydroxybenzophenones such as 2,4-dihydroxybenzophenone, 2,2',4,4'-tetrahydroxybenzopheneone and 2-hydroxy-4-octoxybenzophenone; and 2-hydroxyphenylbenzotriazoles such as 2-(2'-hydroxy-5'-methylphenyl)benzotriazole, 2-(2'-hydroxy-3'-t-butyl-5' -methylphenyl)-5-chlorobenzotriazole and 2-(2'-hydroxy-3', 5' -dibutylphenyl)-5-chlorobenzotriazole.

Most known conventional ultraviolet absorbers have a low-molecular-weight and the adsorbed ultraviolet absorbers are dissolved in a laundering bath. Therefore, the ultraviolet screening action does not last over a long period of time.

SUMMARY OF THE INVENTION

A primary object of the present invention is to provide a method of imparting a durable light resistance and ultraviolet screening action to fibrous articles.

In accordance with the present invention, there is provided a method of imparting a durable light resistance and ultraviolet-screening action to a fibrous article, which comprises coating a fibrous article with a homopolymer or copolymer derived from at least one monomer selected from the group consisting of monomers represented by the following formulae (1) and (2):

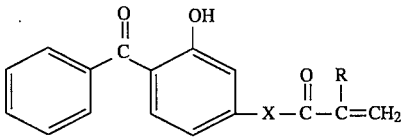

(1)

wherein R is hydrogen or methyl and X is —O—, —$OCH_2CH_2O$— or

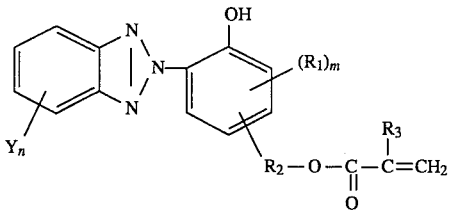

(2)

wherein Y is halogen or methyl, n is 1 or 2, $R_1$ is a hydrocarbon group having 1 to 6 carbon atoms, m is 1 or 2, $R_2$ is a linear or branched chain alkylene group having 1 to 6 carbon atoms and $R_3$ is hydrogen or methyl, or a copolymer derived from at least 5% by weight of at least one monomer selected from the group consisting of monomers represented by the formulae (1) and (2), and not more than 95% by weight of at least one monoethylenically unsaturated monomer copolymerizable therewith.

DESCRIPTION OF THE PREFERRED EMBODIMENTS

Figure 1:
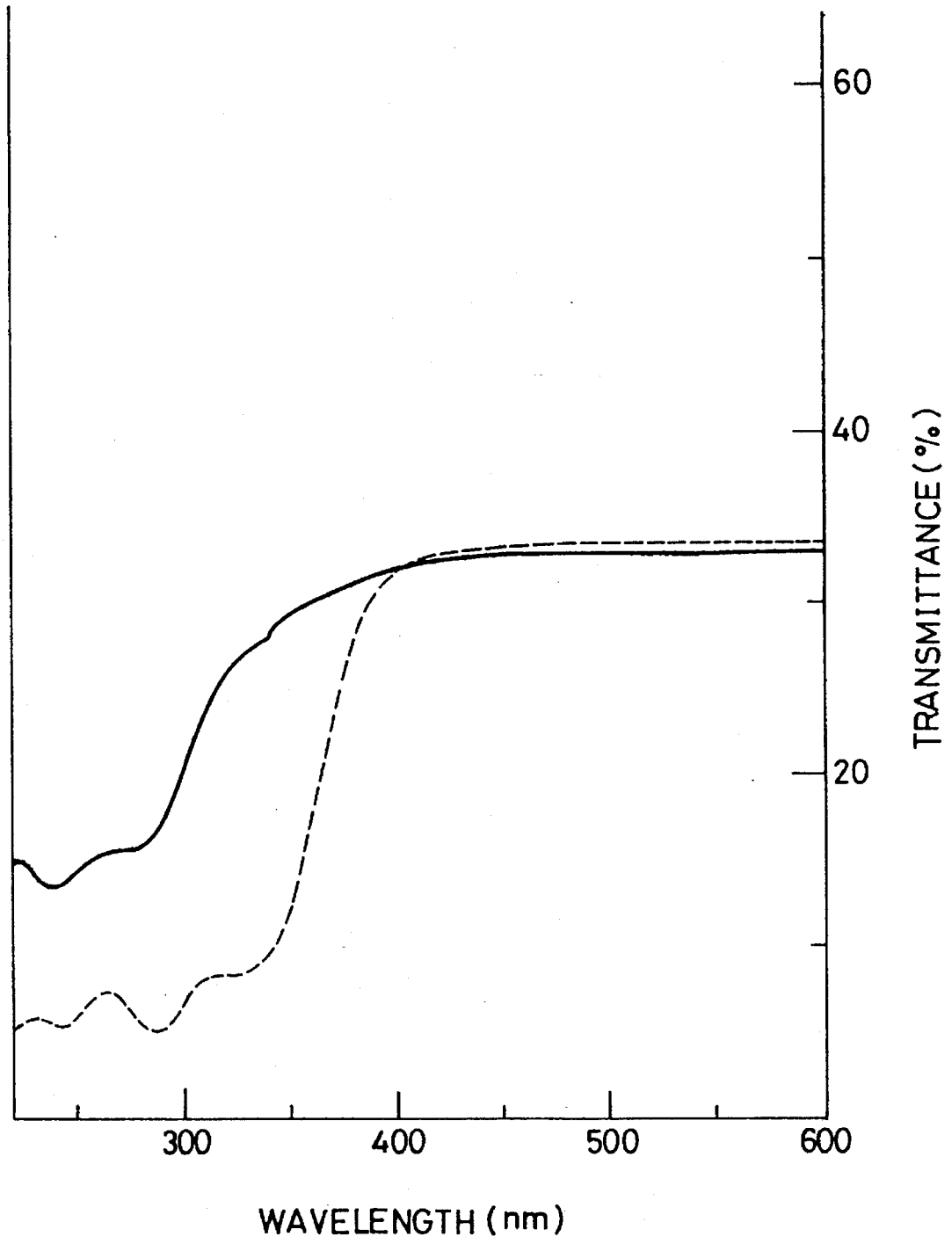
FIG. 1 is a spectral transmissision curve of a fibrous article, which has been treated by the method of the present invention.

As typical examples of the monomers represented by the formula (1), there can be mentioned 2-hydroxy-4 -acryloyloxybenzophenone, 2-hydroxy-4-methacryloyloxybenzophenone, 2-hydroxy-4-(2-acryloyloxy)ethoxybenzophenone, 2-hydroxy-4-(2-methacryloyloxy)ethoxybenzophenone, 2 -hydroxy-4-(2-methyl-2-acryloyloxy)ethoxybenzophenone and 2-hydroxy-4-(2-methyl-2-methacryloyloxy)ethoxybenzophenone.

As typical examples of the monomers represented by the formula (2), there can be mentioned 2-[2'-hydroxy-5'-(methacryloyloxyethyl)phenyl]benzotriazole, 2-[2' -hydroxy-5'-(acryloyloxyethyl)phenyl]benzotriazole, 2-[2' -hydroxy-3'-t-butyl-5'-(methacryloyloxyethyl)phenyl]benzotriazole, 2-[2'-hydroxy-3'-methyl-5'-(acryloyloxyethyl)phenyl] benzotriazole, 2-[2'-hydroxy-5'-(methacryloyloxypropyl)phenyl] -5-chlorobenzotriazole and 2-[2'-hydroxy-5'-(acryloyloxybutyl)phenyl] -5-methylbenzotriazole.

The ultraviolet-absorbing polymer used for coating a fibrous article therewith is a homopolymer or copolymer prepared from at least one monomer selected from the monomers of the formulae (1) and (2), or a copolymer prepared from at least 5% by weight, preferably at least 30% by weight, of at least one of the monomers of the formulae (1) and (2) and not more than 95% by weight, preferably not more than 90% by weight, of at least one copolymerizable monoethylenically unsaturated monomer.

As preferred examples of the copolymerizable monoethylenicaly unsaturated monomers, there can be mentioned acrylic acid, methacrylic acid, alkyl esters of acrylic acid, alkyl esters of methacrylic acid, alkyl vinyl ethers, and vinyl esters of carboxylic acids having 2 to 18 carbon atoms. The alkyl groups in these alkyl esters and ethers preferably have 1 to 18 carbon atoms. The alkyl esters of acrylic acid include, for example, methyl acrylate, ethyl acrylate, propyl acrylate, butyl acrylate and 2-ethylhexyl acrylate. The alkyl esters of methacrylic acid include, for example, methyl methacrylate, ethyl methacrylate, propyl methacrylate, butyl methacrylate and stearyl methacrylate. The alkyl vinyl ethers include, for example, methyl vinyl ether, ethyl vinyl ether, butyl vinyl ether and stearyl vinyl ether. The vinyl carboxylates include, for example, vinyl formate, vinyl acetate, vinyl acrylate, vinyl butyrate, vinyl crotonate and vinyl stearate.

The ultraviolet-absorbing polymer used for coating a fibrous article therewith preferably has a weight average molecular weight of about 5,000 to about 1,000,000, more preferably about 10,000 to about 800,000.

The polymers can be prepared either in a solution polymerization system or an emulsion polymerization system. The polymerization procedure per se may be conventional. As-obtained polymer solutions and emulsions can be used for coating a fibrous article. Where the polymerization is effected in a solution polymerization system using an organic solvent and the as-obtained polymer is used for coating a fibrous article, the solvent must be removed from the polymer solution-coated fibrous article. It is preferable to effect the polymerization in an emulsion polymerization system using an emulsion in water and to coat a fibrous article with the as-obtained polymer emulsion. Where the fibrous article is coated with the as-obtained polymer emulsion, a softener and other additives can be incorporated in the polymer emulsion, and consequently, an after-treatment of the fibrous article can be effected simultaneously with the polymer-coating. The coating with the as-obtained polymer emulsion is ususally effected by dipping the fibrous article in the polymer emulsion, and the dipped fibrous article is squeezed and then dried.

The fibrous articles treated by the method of the invention is not particularly limited and any articles of woven and knitted fabrics and non-woven fabrics can be treated. As typical examples of the fibrous articles treated by the method of the present invention, there can be mentioned sports wears, curtains and beach umbrellas. The kind of fiber also is not limited and any of natural fibers, synthetic fibers and semi-synthetic fibers can be employed.

The coating of a fibrous article can be carried out by a conventional coating procedure such as gravure coating, dip coating or spray coating. The concentration of the ultraviolet-absorbing polymer in the solution or emulsion is not particularly limited, but is preferably 1 to 5% based on the weight of the solution or emulsion. The amount of the ultraviolet-absorbing polymer applied is preferably from 0.1 to 7% by weight o.w.f.

The invention will now be described in detail with reference to the following examples that by no means limit the scope of the invention.

EXAMPLE 1

Solution Polymerization of 2-Hydroxy-4-methacryloyloxybenzophenone with Methyl Methacrylate A separable flask provided with a reflux condenser, a dropping funnel, a thermometer, a nitrogen gas-introducing tube and a stirrer was charged with 111.5 g of 2-hydroxy-4-methacryloyloxybenzophenone, 445 g of methyl methacrylate, 0.4 g of lauryl mercaptan and 560 g of ethyl acetate. While a nitrogen gas was blown through the tube into the flask, the temperature of the contents was elevated to 50° C. A solution of 1.66 g of azobisisobutyronitrile (hereinafter referred to as "AIBN") in a minor amount of ethyl acetate was added dropwise into the flask over a period of about 20 minutes. After the completion of the addition, the temperature of the contents was elevated to 70° C. and polymerization was conducted for about 8 hours at a stirring rate of 100 rpm in an nitrogen gas atmosphere. After the completion of the polymerization, the resultant polymer solution was cooled to room temperature and diluted with toluene to a solid concentration of 20% by weight.

EXAMPLE 2

Solution Polymerization of 2-Hydroxy-4-(2-methacryloyloxy)ethoxybenzophenone with Methyl Methacrylate and Acrylic Acid A solution polymerization was effected by the same procedures as described in Example 1 wherein a monomer charge composed of 167 g of 2-hydroxy-4-(2-methacryloyloxy)ethoxybenzophenone, 450 g of butyl acrylate, 15 g of acrylic acid, 1.7 g of AIBN, 0.5 g of lauryl mercaptan and 600 g of ethyl acetate was used with all other conditions remaining substantially the same, thus producing a polymer solution of a solid concentration of 20% by weight.

EXAMPLE 3

Solution Polymerization of 2-[2'-Hydroxy-3'-t-butyl-5'-(methacryloyloxyethyl)phenyl]benzotriazole with Ethyl Acrylate and Acrylic Acid A solution polymerization was effected by the same procedures as described in Example 1 wherein a monomer charge composed of 160 g of 2-[2'-hydroxy-3'-t-butyl-5'-(methacryloyloxyethyl)phenyl]benzotriazole, 500 g of ethyl acrylate, 5 g of acrylic acid, 1.8 g of AIBN, 0.3 g of lauryl mercaptan and 700 g of ethyl acetate was used with all other conditions remaining substantially the same, thus producing a polymer solution of a solid concentration of 20% by weight.

EXAMPLE 4

Solution Polymerization of 2-[2'-Hydroxy-5'-(acryloyloxypropyl)phenyl] benzotriazole with Ethyl Acrylate and Acrylic Acid A solution polymerization was effected by the same procedures as described in Example 1 wherein a monomer charge composed of 200 g of 2-[2'-hydroxy-5'-(acryloyloxypropyl)phenyl] benzotriazole, 300 g of ethyl acrylate, 10 g of acrylic acid, 1.5 g of AIBN, 0.1 g of lauryl mercaptan and 500 g of ethyl acetate was used with all other conditions remaining substantially the same, thus producing a polymer solution having a solid concentration of 20% by weight.

EXAMPLE 5

Emulsion Polymerization of 2-Hydroxy-4-(2 -methacryloyloxy)ethoxybenzenzophenone with Butyl Acrylate and Acrylic Acid A pre-emulsion composed of 150 g of 2-hydroxy-4-(2-methacryloyloxy)ethoxybenzophenone, 500 g of butyl acrylate, 10 g of acrylic acid, 25 g of sodium dodecylbenzenesulfonate and 800 g of deionized water was prepared. A separable flask provided with a reflux condenser, a dropping funnel, a thermometer, a nitrogen-gas introducing tube and a stirrer was charged with 100 g of deionized water, 5.2 g of potassium peroxide and 0.5 g of potassium acid sulfite. The temperature of the content was elevated to 70° C. with stirring and the pre-emulsion was added gradually dropwise through the dropping funnel into the flask to effect polymerization. After the completion of the addition, the polymerization was continued further for 3 hours, thus producing a polymer emulsion.

EXAMPLE 6

Emulsion Polymerization of 2-Hydroxy-(2-methacryloyloxy)ethoxybenzenzophenone with Ethyl Acrylate and Acrylic Acid A pre-emulsion composed of 150 g of 2-hydroxy-(2-methacryloyloxy)ethoxybenzophenone, 450 g of ethyl acrylate, 20 g of acrylic acid, 20 g of sodium dodecylbenzenesulfonate, 10 g of an adduct of 1 mole of nonylphenol with 10 moles of ethylene oxide and 900 g of deionized water was prepared. The same separable flask as that used in Example 5 was charged with 200 g of deionized water, 6 g of potassium peroxide and 1 g of sodium acid sulfite, and an emulsion polymerization was effected in the same manner as described in Example 5 and by using the pre-emulsion to produce a polymer emulsion.

EXAMPLE 7

Emulsion Polymerization of 2-[2'-Hydroxy-3'-t-butyl-5'-(methacryloyloxyethyl)phenyl]benzotriazole with 2-Ethylhexyl Acrylate A pre-emulsion composed of 150 g of 2-[2' -hydroxy-3'-t-butyl-5'-(methacryloyloxyethyl)phenyl]benzotriazole, 500 g of 2-ethylhexyl acrylate, 30 g of sodium dodecylbenzenesulfonate and 750 g of deionized water was prepared. The same separable flask as that used in Example 5 was charged with 150 g of deionized water, 5 g of potassium peroxide and 0.7 g of potassium acid sulfite, and an emulsion polymerization was effected in the same manner as described in Example 5 and by using the pre-emulsion to produce a polymer emulsion.

EXAMPLE 8

Emulsion Polymerization of 2-[2'-Hydroxy-5' -(acryloyloxypropyl)phenyl]benzotriazole with Butyl Acrylate and Acrylic Acid A pre-emulsion composed of 200 g of 2[2'-hydroxy-5'-(acryloyloxypropyl)phenyl]benzotriazole, 600 g of butyl acrylate, 10 g of acrylic acid, 10 g of sodium dodecylbenzenesulfonate and 20 g of an adduct of 1 mole of nonylphenol with 10 moles of ethylene oxide and 1,000 g of deionized water. The same separable flask as that used in Example 5 was charged with 200 g of deionized water, 7.5 g of potassium peroxide and 1.2 g of potassium acid sulfite, and an emulsion polymerization was effected in the same manner as described in Example 5 and by using the pre-emulsion, to produce a polymer emulsion.

COMPARATIVE EXAMPLE 1

By using a Mecha-Gaper Grain Mill made by Asada Tekko K.K., 500 g of 2-(2'-hydroxy-3'-t-butyl-5' -methylphenyl)-5-chlorobenzotriazole, 1,500 g of deionized water and 50 g of a condensate of sodium naphthalenesulfonate with formaldehyde were mixed together under agitation for 1 hour to produce an aqueous dispersion of a UV absorber.

COMPARATIVE EXAMPLE 2

An aqueous dispersion of a UV absorber was prepared in the same manner as described in Comparative Example 1 wherein 500 g of 2,2',4,4'-tetrahydroxybenzophenone, 1,500 g of deionized water and 35 g of a condensate of sodium naphthalenesulfonate with formaldehyde were used with all other conditions remaining substantially the same.

(1) Evaluation of Light Fastness of Dyed Fiber

A polyester fiber was dyed under the following conditions.

Dyestuff: Yation Blue 5GS, 2% o.w.f.

Acetic acid: 0.3 ml/liter

Bath ratio: 1:15

Dyeing temperature & time: 130° C., 60 minutes

The dyed fiber was dipped in each of the polymer solutions prepared in Examples 1 through 4, squeezed to a pick-up of 100% by weight, and then dried at 100° C. for 3 minutes. Then the light fastness of the dyed fiber was evaluated according to JIS (Japanese Industrial Standard) L-0842 (method of testing a color fastness to carbon arc light). The results are shown in Table 1.

TABLE 1

| | Example 1 | Example 2 | Example 3 | Example 4 | Control* |
|---|---|---|---|---|---|
| Light fastness (Class) | 5 | 5 | 4–5 | 5 | 1–2 |

*Control: Dyed fiber was not coated with the polymer solution.

(2) Evaluation of Light Fastness of Dyed Fiber

An acrylic fiber was dyed under the following conditions.

Dyestuff: C.I. Basic Yellow 40, 0.3% o.w.f.

Acetic acid: 2.0% o.w.f.

Sodium Acetate: 0.5% o.w.f.

Catipon LK (leveling agent, supplied by Ipposha Oil Ind.): 1.0% o.w.f.

Bath ratio: 1:20

Dyeing temperature & time: 100° C., 30 minutes

The polymer emulsions prepared in Examples 5 through 8 and the UV absorber dispersions prepared in Comparative Examples 1 and 2 were diluted to a solid concentration of 2% by weight. The dyed acrylic fiber was dipped in each of the diluted polymer emulsions and UV absorber dispersions, squeezed to a pick-up of 100% by weight, and then dried at 130° C. for 5 minutes. Then the light fastness of the dyed acrylic fiber was evaluated according to JIS L-0842. The results are shown in Table 2.

TABLE 2

| | Example 5 | Example 6 | Example 7 | Example 8 | Comp. Ex. 1 | Comp. Ex. 2 |
|---|---|---|---|---|---|---|
| Light fastness (Class) | 5 | 4–5 | 5 | 4–5 | 4 | 2–3 |

(3) Evaluation of Ultraviolet Screening Action

The polymer solutions prepared in Examples 1 and 3 were diluted with toluene to a solid concentration of 2% by weight, and the polymer emulsions prepared in Examples 5, 6 and 8 and the UV absorber dispersions prepared in Comparative Examples 1 and 2 were diluted to a solid concentration of 2% by weight. Cotton muslin and cotton taffeta were dipped in each of the diluted polymer solutions and emulsions, and the UV absorber dispersions, squeezed to a pick-up of 100%, and then dried at 100° C. for 3 minutes. The ultraviolet transmittances of the thus-treated cotton muslin and cotton taffeta were determined by using an integrating sphere-provided autographic recording spectrophotometer, model U-3210 supplied by Hitachi Ltd. The results are shown in Table 3. The spectral transmission curve of the cotton muslin treated by the polymer emulsion of Example 6 and the spectral transmission curve of the untreated cotton muslin are shown by a dotted line and a solid line, respectively, in FIG. 1.

TABLE 3

| | Ultraviolet Transmittance (%) | | | | | |
|---|---|---|---|---|---|---|
| Fibrous article | Cotton muslin | | | Cotton taffeta | | |
| Wave length (nm) | 400 | 330 | 290 | 400 | 330 | 290 |
| Example 1 | 22 | 13 | 10 | 26 | 15 | 10 |
| Example 3 | 26 | 15 | 7 | 29 | 17 | 10 |
| Example 5 | 27 | 12 | 5 | 30 | 18 | 10 |
| Example 6 | 33 | 9 | 5 | 29 | 18 | 11 |
| Example 8 | 16 | 10 | 6 | 28 | 16 | 10 |
| Comp. Ex. 1 | 29 | 10 | 10 | 37 | 20 | 12 |
| Comp. Ex. 2 | 30 | 17 | 10 | 47 | 31 | 10 |
| Control* | 33 | 25 | 13 | 51 | 37 | 15 |

*Control: UV transmittances untreated cotton muslin and cotton taffeta (4) Evaluation of Ultraviolet Screening Action after Laundering The polymer solutions prepared in Examples 2 and 4 were diluted with toluene to a solid concentration of 2% by weight, and the polymer emulsions prepared in Examples 5, 7 and 8 and the UV absorber dispersions prepared in Comparative Examples 1 and 2 were diluted to a solid concentration of 2% by weight. Cotton taffeta was dipped in each of the diluted polymer solutions and emulsions and the diluted UV absorber dispersions, squeezed to a pick-up of 100% by weight, and then dried at 100° C. for 3 minutes. The thus-treated cotton taffeta was cut into a size of 10 cm×5 cm. The cut taffeta was placed together with 5 g of a powder soap, 100 ml of water and 10 stainless steel balls (SUS 420 J2), in a cylindrical vessel having an inner diameter of 8 cm and a height of 12 cm. A laundering test was conducted according to JIS L-0844, method A-2. The ultraviolet transmissions of the cotton taffeta were measured at a wavelength of 330 nm by the same method as described in the preceding paragraph (3) at the laundering times shown in Table 4. The results are shown in Table 4.

TABLE 4

| | Ultraviolet Transmittance after Laundering (%) | | | | | |
|---|---|---|---|---|---|---|
| Laundering times | 1 | 2 | 3 | 5 | 10 | 20 |
| Example 2 | 14 | 14 | 13 | 14 | 15 | 15 |
| Example 4 | 15 | 15 | 16 | 15 | 15 | 15 |
| Example 5 | 18 | 18 | 19 | 18 | 18 | 17 |
| Example 7 | 16 | 16 | 16 | 16 | 17 | 17 |
| Example 8 | 20 | 22 | 21 | 21 | 22 | 22 |
| Comp. Ex. 1 | 21 | 29 | 35 | 34 | 36 | 35 |
| Comp. Ex. 2 | 30 | 33 | 36 | 36 | 35 | 36 |
| Control* | 36 | 35 | 37 | 34 | 35 | 36 |

*Control: UV transmissions of untreated cotton taffeta

The polymeric UV absorbers used in the present invention can be uniformly coated on the entire surface of fiber. Light is partly reflected on the polymer coating and partly absorbed by the polymer coating, and the light transmitted through the polymer coating is very minor. Therefore, deterioration of fiber and discoloration of colored fiber due to ultraviolet light can be minimized, and sunburn of the skin and discoloration of furnishings can be prevented or minimized. The polymeric UV absorbers firmly adhere to fiber and have a good resistance to laundering, and therefore, the UV screening action is durable over a long period of time.

What is claimed is:

1. A method of providing a durable light resistance and ultraviolet-screening coating to a fibrous article, which comprises coating a fibrous article with an aqueous copolymer emulsion; which is obtained by an emulsion copolymerization and emulsion consists essentially of at least 5% by weight of units derived from at least one monomer selected from the group consisting of the monomers represented by the following formulas (1) and (2):

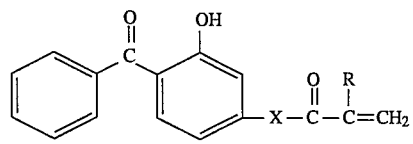

(1)

wherein R is hydrogen or methyl and X is —O—, —$OCH_2CH_2O$— or

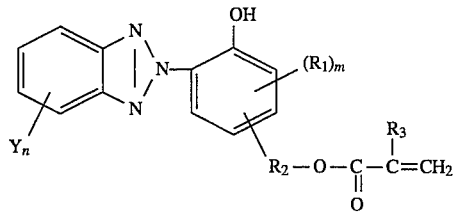

(2)

wherein Y is halogen or methyl, n is 1 or 2, $R_1$ is a hydrocarbon group having 1 to 6 carbon atoms, m is 1 or 2, $R_2$ is a linear or branched chain alkylene group having 1 to 6 carbon atoms and $R_3$ is hydrogen or methyl, and not more than 95% by weight of units derived from at least one monoethylenically unsaturated monomer selected from the group consisting of acrylic acid, methacrylic acid, alkyl esters of acrylic acid having 1 to 18 carbon atoms in the alkyl group, alkyl esters of methacrylic acid having 1 to 18 carbon atoms in the alkyl group, alkyl vinyl ethers having 1 to 18 carbon atoms in the alkyl group, and vinyl esters of carboxylic acids having 2 to 18 carbon atoms.

2. The method of claim 1 wherein the copolymer of the monomer of the formula (1) or (2) with the monoethylenically unsaturated monomer has a weight-average molecular weight of about 5,000 to about 1,000,000.

3. The method of claim 1, wherein the emulsion contains 1 to 5% by weight of the copolymer of the monomer of the formula (1) or (2) and the monoethylenically unsaturated monomer.

4. The method of claim 1 wherein the amount of the copolymer of the monomer of the formula (1) or (2) and the monoethylenically unsaturated monomer is 0.1 to 7% by weight based on the weight of the fibrous article.

5. The method of claim 1 wherein the fibrous article comprises at least one fiber selected from the group consisting of polyester fiber, acrylic fiber and cotton.

6. The method of claim 1 wherein the fibrous article coated with the emulsion is dried at a temperature of at least about 100° C.

7. The method of claim 2 wherein the fibrous article coated with the emulsion is dried at a temperature of at least about 100° C.

8. The method of claim 4 wherein the fibrous article coated with the emulsion is dried at a temperature of at least about 100° C.

* * * * *